US005936335A

United States Patent [19]

Clerc

[11] Patent Number: 5,936,335

[45] Date of Patent: Aug. 10, 1999

[54] ELECTRON GUN HAVING A GRID

[75] Inventor: Guy Clerc, Thonon, France

[73] Assignee: Thomson Tubes Electroniques, Meudon la Foret, France

[21] Appl. No.: 08/945,675

[22] PCT Filed: Apr. 26, 1996

[86] PCT No.: PCT/FR96/00644

§ 371 Date: Nov. 5, 1997

§ 102(e) Date: Nov. 5, 1997

[87] PCT Pub. No.: WO96/35219

PCT Pub. Date: Nov. 7, 1996

[30] Foreign Application Priority Data

May 5, 1995 [FR] France ..... 95 05408

[51] Int. Cl.[6] ..... H01J 29/50

[52] U.S. Cl. ..... 313/346 R; 313/458; 313/346 DC; 313/293

[58] Field of Search ..... 313/293, 414, 313/446, 447, 448, 458, 412, 346 R, 346 DC

[56] References Cited

U.S. PATENT DOCUMENTS

| | | | |
|---|---|---|---|
| 3,535,758 | 10/1970 | Hoet | 29/25.18 |
| 4,429,250 | 1/1984 | Clerc et al. . | |
| 4,553,064 | 11/1985 | Amboss | 313/448 |
| 4,563,609 | 1/1986 | Clerc et al. . | |
| 4,577,134 | 3/1986 | Clerc . | |
| 4,583,021 | 4/1986 | Herriott et al. | 313/304 |
| 4,737,680 | 4/1988 | True et al. | 313/349 |
| 4,745,326 | 5/1988 | Greene et al. | 313/346 DC |
| 5,399,935 | 3/1995 | Santonja et al. | 313/447 |
| 5,682,084 | 10/1997 | Langlois et al. . | |

*Primary Examiner*—Sandra O'Shea
*Assistant Examiner*—Michael J. Smith
*Attorney, Agent, or Firm*—Oblon, Spivak, McClelland, Maier & Neustadt, P.C.

[57] ABSTRACT

The present invention relates to an electron gun having a grid and a cathode with the cathode having an emissive part (12) which defines a central hole (11) in order to reduce spurious electron emissions from the grid to enhance cooling.

20 Claims, 4 Drawing Sheets

ELECTRON GUN HAVING A GRID

BACKGROUND OF THE INVENTION

1. Field of the Invention

The field of the invention is that of electron tubes and in particular those having longitudinal electron beams and having a grid, such as TOTs (Inductive Output Tubes).

2. Discussion of Background

An IOT has an electron gun which emits an electron beam, a resonant cavity through which the beam passes and a collector which receives the beam electrons as they leave the cavity.

The electron gun has a generally concave cathode in the form of a portion of a sphere, a control grid and an anode. The concave face of the cathode emits electrons when it is raised to a high temperature. The electrons pass through the control grid and are attracted by the anode and then enter the resonant cavity, forming a longitudinal beam.

The control grid serves to modulate the emission of electrons so as to group them into packets before they enter the resonant cavity.

The cathode is generally formed by a porous body impregnated with an emissive material. The porous body is made of tungsten and the emissive material of barium, calcium and strontium aluminates. It starts to emit electrons in the region of 900° to 1100° C.

The control grid is very close to the cathode. The gap between the grid and the cathode is about a few tenths of a millimetre. The emissive material has a tendency to evaporate and migrate in particular onto the control grid and onto the anode. The grid heats up, on the one hand, because of the proximity of the cathode and, on the other hand, because of the electrons which strike it. The emissive material which has migrated onto the grid causes spurious electron emission which disturbs the operation of the tube. Since the anode is relatively far from the cathode, it remains relatively cool, and the emissive material which covers it is not too much of a problem.

Solutions have been proposed for eliminating this spurious electron emission. One of them recommends bombarding the grid with electrons in order to heat it and cause the emissive material covering it to evaporate. The frequency of this heating may be daily, for example before each start-up. Cleaning the grid by heating is a severe constraint on an emitter of a television which may operate in a remote spot with remote control. Long term, this heating may also cause degradation in the operation of the electron gun.

Another approach taken for avoiding this spurious electron emission consists in decreasing as much as possible the temperature of the grid during operation of the tube. A known solution is to use a cathode working at temperatures lower than those of conventional cathodes, thereby lowering the temperature of the control grid. This solution does not give good results either. The spurious emission phenomenon is not eliminated, merely retarded.

Another drawback encountered is that the spurious emission from the control grid limits the size of the cathode and consequently the electron current produced.

SUMMARY OF THE INVENTION

The present invention is intended to remedy these drawbacks by proposing an electron gun whose cathode helps to cool the grid better and effectively prevents the spurious emission.

This cathode has an emissive part which delimits a more or less central hole passing right through it.

The cathode is advantageously heated by a heater which has a heating element on the opposite side from its emissive part, this heating element delimiting a hole facing the hole in the cathode.

The grid has a thermally radiative solid part intended to be placed lying opposite the hole in the cathode. The radiative heat dissipation of the grid is improved by this thermally radiative solid part since it can radiate towards the hole in the cathode and towards the anode region which is a cold region. Since the grid is cooled better, spurious electron emission is eliminated.

It is preferable to make the solid part from a material having a thermal radiation capacity close to that of a black body. Pyrolytic graphite is particularly advantageous.

The present invention also relates to an electron tube having such a gun.

BRIEF DESCRIPTION OF THE DRAWINGS

Other features and advantages of the invention will appear on reading the description below, this being illustrated by the appended figures which represent.

DETAILED DESCRIPTION OF THE PREFERRED EMBODIMENT

In these figures, the same references denote the same elements. For reasons of clarity, the dimensions of the various components have not been respected.

Figure 1A:
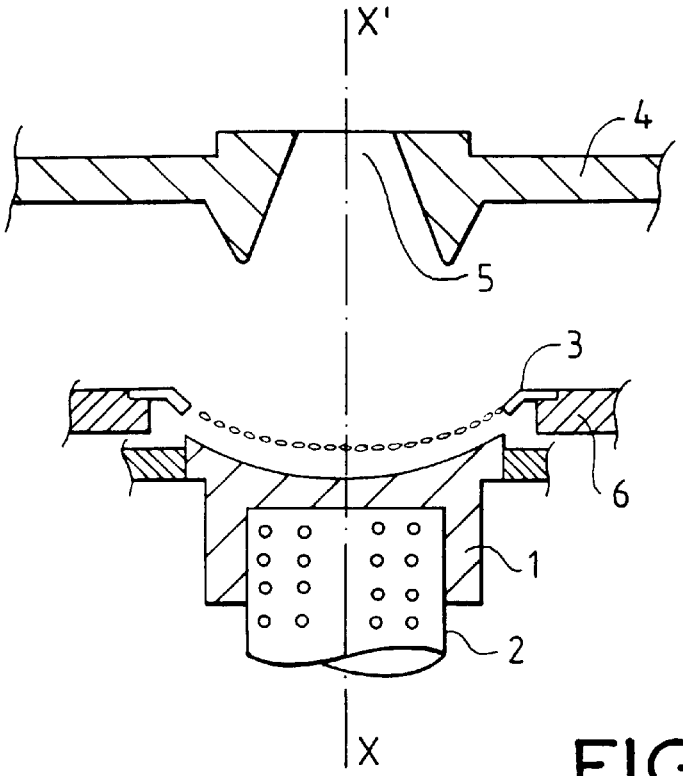
FIG. 1a PRIOR ART
FIGS. 1*a*, 1*b*, respectively a longitudinal section of an electron gun of the prior art and a front view of its grid.

FIG. 1*a* shows a known electron gun in longitudinal section. The cathode bears the reference 1. It is solid and in the form of a portion of a sphere, its active face being concave. A heater 2 is in contact with the cathode 1 on the opposite side from its active face. The electrons emitted by the active face of the cathode 1 pass through a control grid 3 and are attracted by an anode 4. They form a longitudinal beam of axis XX'. The anode 4 has a central aperture 5 for letting the electron beam enter a resonant cavity (not shown). The anode 4 is raised to a more positive potential than the cathode 1. The grid 3 is generally raised to a potential intermediate between that of the cathode 1 and that of the anode 4.

Figure 1B:
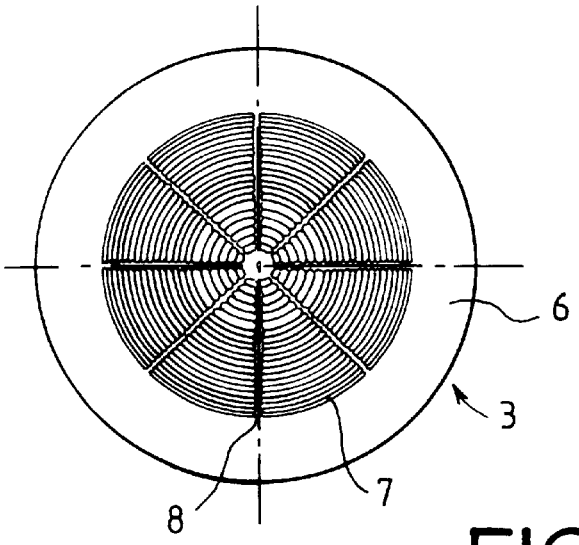
FIG. 1b PRIOR ART

The grid 3 is mounted on a peripheral support 6 made from a material which is a good thermal conductor, such as copper. It is also in the form of a portion of a sphere, with first bars 7 lying along lines of latitude of the sphere and second bars 8 lying along meridians of the sphere. The two spherical portions, i.e. that of the cathode 1 and that of the grid 3, have their centre on the axis XX'. FIG. 1*b* shows the drawing of the grid from the front.

When the cathode 1 heats up, emissive material is evaporated and covers, in particular, the grid 3. By heating up, the grid starts to emit spurious electrons. The grid 3 is cooled, on the one hand by conduction to the peripheral support 6 via the first and second bars 7, 8 and, on the other hand, by radiation, essentially towards the anode 4.

The hottest part of the grid 3 is its central part. Any increase in the size of the cathode 1 leads to an increase in the size of the grid 3 and therefore the temperature of its central part. In order to avoid increasing the spurious emission from the grid 3, it is necessary to limit the size of the cathode 1 and consequently the electron current which it delivers.

Figure 2A:
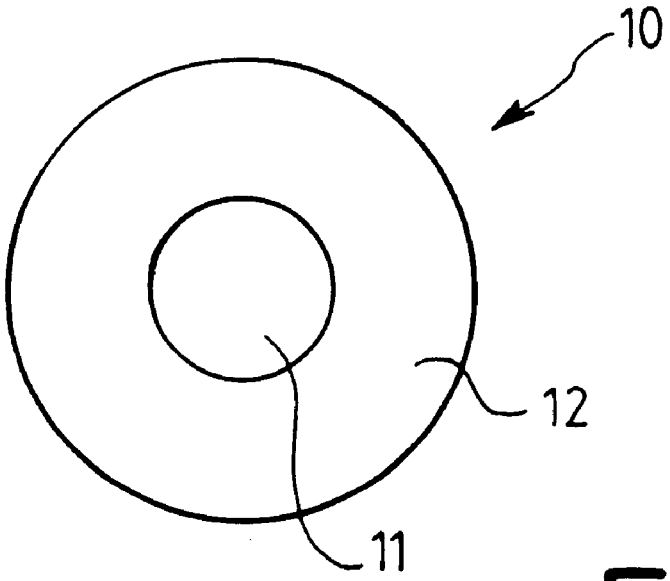
FIGS. 2*a*, 2*b* respectively a front view and a cross-section of an example of a cathode of a gun according to the invention.
Figure 2B:
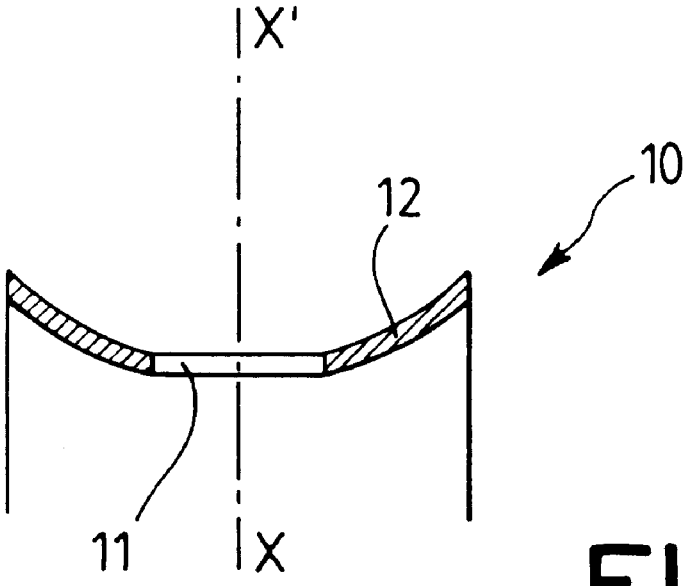

FIGS. 2*a* and 2*b* show, from the front and in longitudinal section, an example of a cathode 10 of a gun according to the invention. In this figure, the cathode is a portion of a sphere. It has an emissive part 12 which delimits a more or less central hole 11.

Preferably, for the sake of simplification, the emissive part 12 is concave and more or less in the form of a segment of a sphere, and the hole 11 is more or less circular. The emissive surface area of a cathode, such as that in FIG. 1*a*, varies to a first approximation as the square of its diameter. In the case of a cathode according to the invention with a hole, if the diameter of the hole 11 represents approximately 30 to 40% of the diameter of the cathode 10, the area of the hole 11 is relatively small and has virtually no effect on the electron emission. The small reduction in emissive surface area may be compensated for by a slight increase in the diameter of the cathode 10. For example, a solid conventional cathode in the form of a spherical cap 38 millimetres in diameter has the same surface area as a cathode according to the invention whose emissive part is a spherical segment 40 millimetres in diameter and whose hole has a diameter of 15 millimetres.

Figure 3:
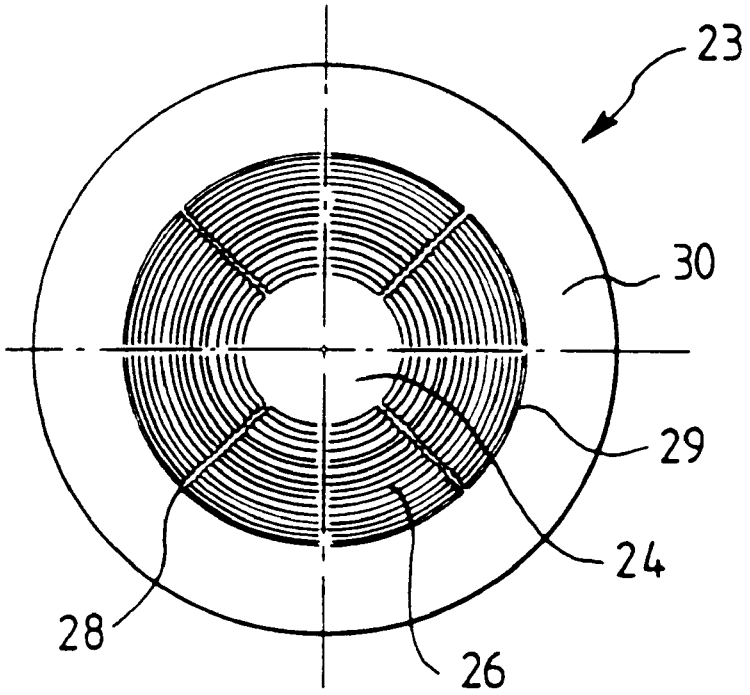
FIG. 3, a front view of an example of a grid of a gun according to the invention.

FIG. 3 shows the drawing of a grid of a gun according to the invention. This grid is intended to be combined with a cathode of the type shown in FIGS. 2*a* and 2*b*. The grid has a thermally radiative solid part 24 intended to be placed opposite the hole in the cathode. When the grid is mounted in an electron gun with such an electron-emitting cathode, it can radiate, on the one hand, towards the anode and, on the other hand, towards the hole in the cathode. This grid is cooled effectively and the spurious electron emission is eliminated. With better cooling of the grid, the diameter of the cathode is independent of the temperature of the grid, and it is conceivable to design more powerful electron tubes with this type of gun.

In a preferred embodiment of the grid, the solid part 24 of the grid 23 is made from a material having a thermal radiation capacity close to that of a black body. Graphite, and more particularly pyrolytic graphite, is a material particularly well-suited to making this thermally radiative solid part 24.

The grid shown in FIG. 3 has, around the solid part 24, a perforated part 26 which is intended to be penetrated by the electrons emitted by the cathode. The perforated part 26 could also be made of pyrolytic graphite because of its advantageous thermal, electrical and mechanical properties.

If the grid 23 is intended to be used with a cathode more or less in the form of a portion of a sphere, it is preferable for the grid to be also more or less in the form of a portion of a sphere. The solid part 24 may be in the form of a spherical cap and the perforated part 26 may have first bars 28 lying along meridians of the sphere and second bars 29 along lines of latitude of the sphere.

The grid 23 may be produced from a blank made of pyrolytic graphite, for example in the form of a portion of a sphere, from which the bars 28, 29 and the solid part 24 are cut. This cutting may be performed conventionally, for example by laser machining or by jet sand blasting.

It would also be conceivable for the perforated part 26 of the grid to have more or less rectangular or hexagonal apertures.

Figure 4:
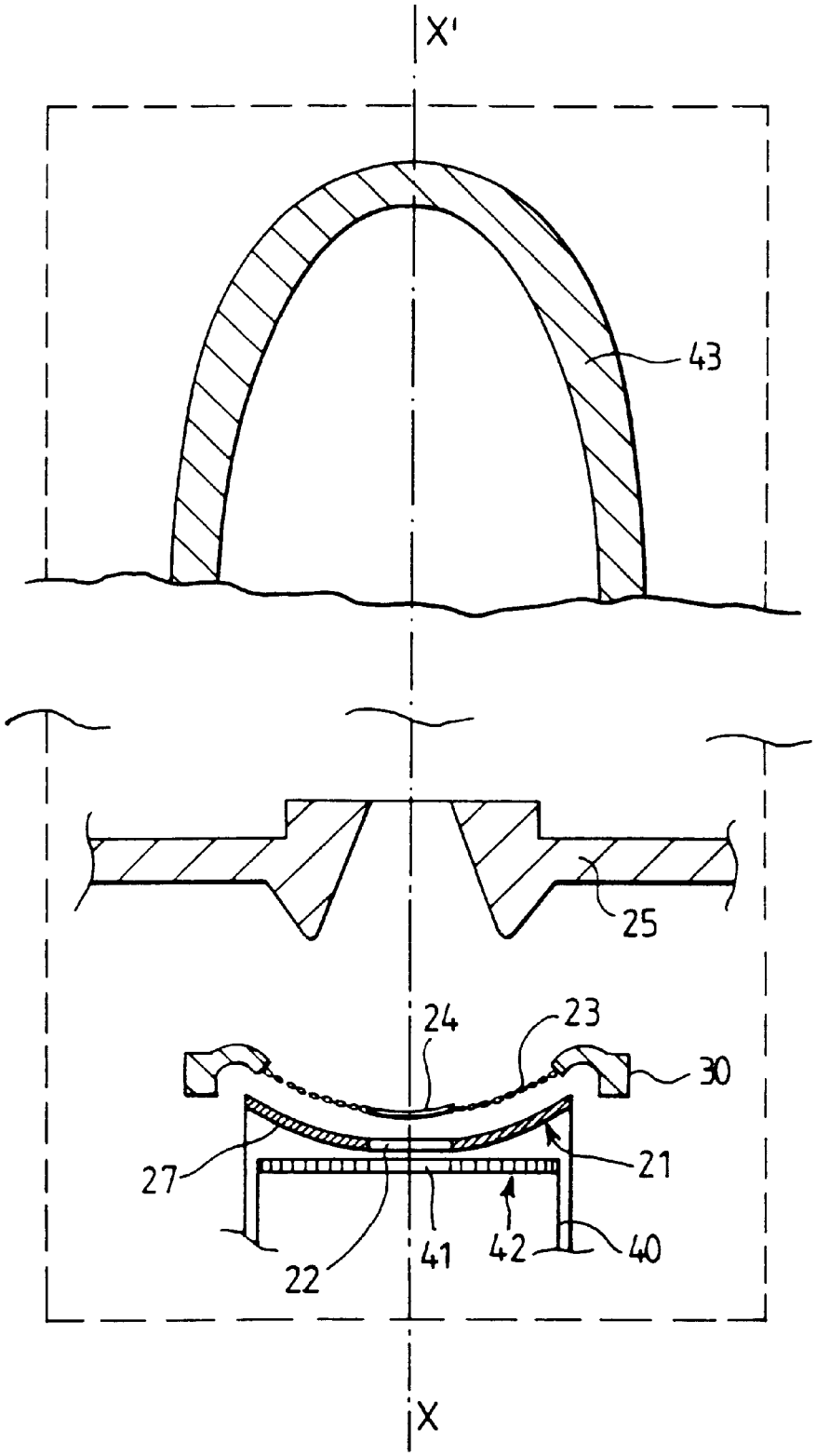
FIG. 4, a longitudinal diagrammatic section so an example of an electron gun according to the invention, mounted in an electron tube also according to the invention.

FIG. 4 shows, in longitudinal cross-section, an example of an electron gun according to the invention mounted in an electron tube also according to the invention. The gun has a cathode 21 according to the invention and a control grid 23, both being more or less in the form of a portion of a sphere. In the figure, the cathode 21 has an emissive part 27 in the form of a segment of a sphere which delimits a more or less central hole 22. An anode 25 and a heater 40 for heating the cathode have also been shown in this figure. The electron tube is shown in part. It contains the electron gun, and the electrons emitted are recovered, at the end of their path, in a collector 43.

In this figure, the grid 23 associated with the cathode according to the invention has a solid part 24. It is similar to that shown in FIG. 3. Its thermal dissipation is better than in the gun shown in FIG. 1*a*.

If the grid 23 is surrounded by a peripheral support 30 made from a material which is a good thermal conductor, such as copper, the heat dissipation is even better. In this configuration, the bars 28, 29 of the grid are cooled by conduction, both to the peripheral support 30 and to the thermally radiative solid part 24. The solid part 24 is cooled by radiating towards the anode 25 and towards the hole 22 in the cathode 21. The length of the first bars 28 is considerably shorter than that of the bars shown in FIG. 1*b*. For example, their length may be reduced from approximately 41 millimetres in the previously mentioned example to approximately 14.5 millimetres.

Preferably, in order to achieve the most effective cooling and the least disturbance of the emitted electron beam, the solid part 24 of the grid 23 will be more or less the same size as the hole 22 in the cathode 21.

It would be conceivable for the cathode according to the invention to be combined with a grid having no solid part, i.e. a conventional grid like the one in FIG. 1*b*, for example. If this grid is made from a material having a radiation capacity close to that of a black body, that part of the grid opposite the hole in the cathode can radiate towards this hole. The cooling of the central part of the grid is improved compared to that of a grid like the one shown in FIG. 1*a* and associated with a solid cathode, but it is not as good as in the case shown in FIG. 4. However, in some cases this cooling is quite sufficient.

Figure 5:
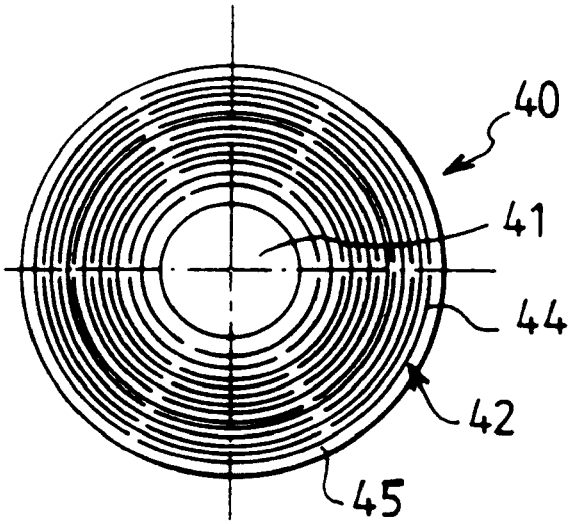
FIG. 5, a front view of a device for heating the cathode of the gun according to the invention.

The cathode must be heated in order to be able to emit electrons. A heater 40 for heating the cathode indirectly has been shown in FIG. 4. It is shown from the front in FIG. 5. It is designed to heat the emissive part 27 of the cathode 21. It is placed close to the convex face of the cathode 21. It has a heating element 42 delimiting a hole 41 opposite the hole 22 in the cathode 21. It may be in the form of a perforated plate defining an array of conductors 45 through which an electric current can pass. This plate will be preferably made from a material which is a good electrical conductor, having a thermal radiation capacity close to that of a black body. Pyrolytic graphite is particularly suitable for making the heating element 42. In the example shown in FIG. 5, this plate has a series of concentric circularly arcuate slots 44, the slots 44 placed on two successive circles being offset with respect to each other. The space between the slots 44 forms the array of electrical conductors 45.

The gun according to the invention is not limited to a cathode in the form of a portion of a sphere or to a grid in the form of a portion of a sphere.

I claim:

1. An electron gun having a grid, said gun including a cathode with an emissive part, wherein the emissive part delimits a substantially centrally positioned aperture which entirely passes through the emissive part and wherein said grid is positioned opposite said aperture whereby said hole functions to assist in the cooling of said grid.

2. Electron gun according to claim 1, characterized in that the emissive part of the cathode is more or less a segment of a sphere.

3. Electron gun according to claim 1, characterized in that the hole in the cathode is more or less circular.

4. Electron gun according to claim 2, characterized in that the diameter of the hole in the cathode represents from approximately 30 to 40% of the diameter of the emissive part.

5. Electron gun according to claim 1, characterized in that it includes a heater for heating the cathode with a heating element (42) which delimits a hole (41) lying opposite the hole (22) in the cathode.

6. Electron gun according to claim 5, characterized in that the heating element is a perforated plate defining an array of electrical conductors.

7. Electron gun according to claim 5, characterized in that the heating element is made of pyrolytic graphite.

8. Electron gun according to claim 1, characterized in that the grid has a thermally radiative solid part intended to lie opposite the hole in the cathode (21).

9. Electron gun according to claim 8, characterized in that the thermally radiative solid part of the grid has more or less the same dimensions as the hole in the cathode.

10. Electron gun according to claim 8, characterized in that the thermally radiative solid part of the grid is made from a material having a thermal radiation capacity close to that of a black body.

11. Electron gun according to claim 10, characterized in that the thermally radiative solid part of the grid is made of pyrolytic graphite.

12. Electron gun according to claim 8, characterized in that the grid has a perforated part around the solid part, this perforated part being intended to be penetrated by the electrons emitted by the cathode.

13. Electron gun according to claim 12, characterized in that the grid more or less in the form of a portion of a sphere has a perforated part with first bars lying along meridians of the sphere and second bars along lines of latitude of the sphere.

14. Electron gun according to claim 8, characterized in that the thermally radiative solid part of the grid is more or less in the form of a spherical cap.

15. Electron gun according to claim 1, characterized in that the grid is surrounded by a peripheral support made from a material which is a good thermal conductor.

16. Electron tube, characterized in that it contains an electron gun having a grid according to claim 1.

17. Electron gun according to claim 2, characterized in that the hole in the cathode is more or less circular.

18. Electron gun according to claim 3, characterized in that the diameter of the hole in the cathode represents from approximately 30 to 40% of the diameter of the emissive part.

19. Electron gun according to claim 2, characterized in that it includes a heater for heating the cathode with a heating element which delimits the hole lying opposite the hole in the cathode.

20. Electron gun according to claim 3, characterized in that it includes a heater for heating the cathode with a heating element which delimits the hole lying opposite the hole in the cathode.

* * * * *